US005329832A

United States Patent [19]

Tegethoff

[11] Patent Number: 5,329,832

[45] Date of Patent: Jul. 19, 1994

[54] PULL TAB CAN OPENER

[76] Inventor: Ronald E. Tegethoff, 729 Lincoln Ave., Prescott, Ariz. 86301

[21] Appl. No.: 159,101

[22] Filed: Nov. 30, 1993

Related U.S. Application Data

[63] Continuation of Ser. No. 990,330, Dec. 10, 1992, abandoned.

[51] Int. Cl.[5] ..... B67B 7/00

[52] U.S. Cl. ..... 81/3.55; 81/3.41; 81/177.3

[58] Field of Search ..... 7/151, 162; 81/3.09, 81/3.41, 3.55, 177.3; 30/298

[56] References Cited

U.S. PATENT DOCUMENTS

| | | | |
|---|---|---|---|
| 334,486 | 1/1886 | Strong et al. | 81/177.3 |
| 2,585,641 | 2/1952 | Faso | 81/177.3 |
| 4,869,134 | 9/1989 | Sprecher | 81/3.55 X |
| 4,919,016 | 1/1990 | Hanegraaf | 81/3.55 |
| 5,029,495 | 7/1991 | Rosenberger | 81/3.55 X |
| 5,275,068 | 1/1994 | Wrench | 30/298 X |

*Primary Examiner*—James G. Smith
*Attorney, Agent, or Firm*—Harry M. Weiss

[57] ABSTRACT

Pull tab can opener, comprising a non flexible hook attached to an adjustable band to be wrapped around a finger digit and worn as a finger band to allow ease, speed and safety in opening pull tab cans.

4 Claims, 1 Drawing Sheet

PULL TAB CAN OPENER

This is a continuation of co-pending application Ser. No. 07/990,330 filed on Dec. 10, 1992 abandoned.

BACKGROUND OF INVENTION

1. Field of the Invention

The invention relates generally to a tool for opening pull tab cans.

2. Description of the Prior Art

The general method of opening pull tab cans is to use one's fingertip which in many instances causes injury to fingernails and in repetitive practice may cause damage to finger joints. This invention eliminates the danger of injury while affording the user unincumbered use of their fingers without having to remove the tool.

SUMMARY OF THE INVENTION

The invention relates to a tool for hooking the pull tabs on pull tab cans. It comprises a means of attaching the hook to the user's finger digit.

It is an object of the invention to provide an inexpensive tool for safe and productive opening of pull tab cans.

DESCRIPTION OF THE PREFERRED EMBODIMENT

Figure 1:
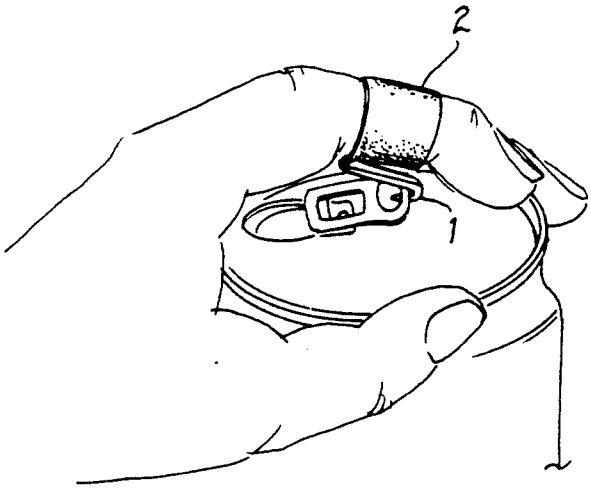
FIG. 1 is a sketch of the tool in use.
Figure 2:
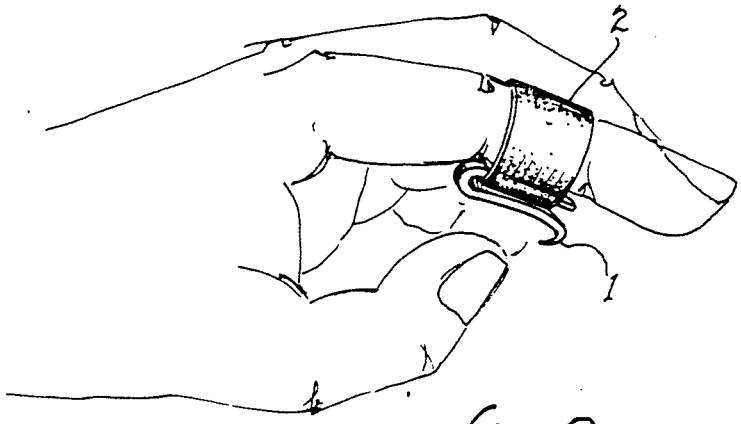
FIG. 2 is a sketch of the tool attached to a finger digit.
Figure 3:
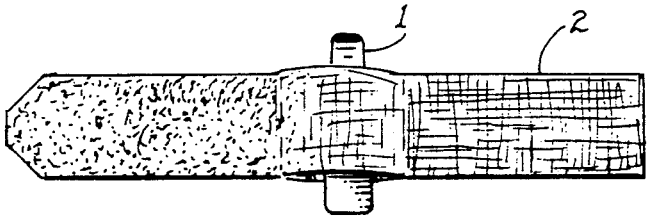
FIG. 3 is a view of the tool from the attachment side.
Figure 4:
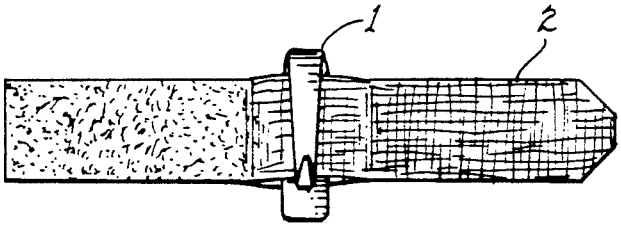
FIG. 4 is a view of the tool from the working side.

Referring to FIGS. 3 and 4, an embodiment of the pull tab can opener comprises a hook 1 and finger attachment strap 2. The hook 1 comprises a hook manufactured from stainless steel, or plastic, or other nonflexible but durable material. The attaching band 2 comprises a short piece of material for attaching the hook 1 to any finger digit. The attaching band is manufactured from any flexible material for universal finger size adjustment and the strap may be secured to the finger by using valcro, snaps, or other fastening method. The attaching band may also be manufactured from a solid ring with the hook attached.

I claim:

1. A can opener tool for opening a can having a pull tab attached to a scored closure member integrally formed in a top side of the can, the can opener tool comprising: a flexible strap of self adhesive material ordinarily wrapped completely around any digit of a finger; and opener means comprising a single solid hook attachment connected to said flexible strap of self adhesive material for engaging pull tabs for opening said can which is utilized by the natural flexation of the finger as a hand is placed over the top side of the can to lift the can, the hook engaging the pull tab and with the natural flexation of the finger when lifting the can, the pull tab of the can is pulled upward by the can opener tool forcing the scored closure member on the can to move inward opening the can, the flexible strap is comprised of one piece of flexible self adhesive material with a slit in a center of the flexible strap by which the solid hook of the can opener tool is secured in the slit and therefore secured snugly against a palm side of a finger digit of the user's finger holding the hook when the strap is wrapped around the finger digit.

2. The can opener tool of claim 1 wherein the flexible strap for finger digit attachment is adjustable to fit snugly around any finger digit to secure the can opener tool to the finger digit.

3. The can opener tool of claim 1 wherein the solid hook comprises a flat two sided piece of metal bent at one end to form a hook comprised of a 180 degree bend at the end of the two sided metal piece which hook secures the metal piece to a pull tab when the can opener tool is being used to open pull tab cans.

4. A can opener tool for opening a can having a pull tab attached to a scored closure member integrally formed in a top side of the can, the can opener tool comprising: a flexible strap of self adhesive material ordinarily wrapped completely around any digit of a finger; and opener means comprising a single solid hook attachment connected to said flexible strap of self adhesive material for engaging pull tabs for opening said can which is utilized by the natural flexation of the finger as a hand is placed over the top side of the can to lift the can, the hook engaging the pull tab and with the natural flexation of the finger when lifting the can, the pull tab of the can is pulled upward by the can opener tool forcing the scored closure member on the can to move inward opening the can, the solid hook comprises a flat two sided piece of metal with a bend in a center of the two sided piece of metal comprised of a 180 degree bend to comprise a means for inserting the hook to the flexible strap.

* * * * *